US005329707A

United States Patent [19]

Chaigne et al.

[11] Patent Number: 5,329,707

[45] Date of Patent: Jul. 19, 1994

[54] SKI BOOT

[75] Inventors: Jérôme Chaigne, Saint-Jorioz; René Borel, Annecy, both of France

[73] Assignee: Salomon S.A., Anncy Cedex, France

[21] Appl. No.: 828,682

[22] Filed: Jan. 31, 1992

[30] Foreign Application Priority Data

Feb. 1, 1991 [FR] France ..... 91 01343

[51] Int. Cl.[5] ..... A43B 5/04

[52] U.S. Cl. ..... 36/120; 36/121

[58] Field of Search ..... 36/117-121

[56] References Cited

U.S. PATENT DOCUMENTS

| | | | |
|---|---|---|---|
| 4,019,267 | 4/1977 | Sadler | 36/120 |
| 4,611,415 | 9/1986 | Tonel | 36/120 |
| 4,839,973 | 6/1989 | Dodge | 36/121 |
| 4,916,835 | 4/1990 | Begey et al. | 36/120 X |
| 4,922,635 | 5/1990 | Zanco | 36/120 |
| 5,005,303 | 4/1991 | Bonaventure et al. | 36/120 |
| 5,031,341 | 7/1991 | Paris et al. | 36/121 |
| 5,054,215 | 10/1991 | Tonel et al. | 36/120 |
| 5,065,533 | 11/1991 | Paris | 36/117 |
| 5,107,609 | 4/1992 | Sartor | 36/120 |
| 5,193,294 | 3/1993 | Pozzobon et al. | 36/120 |
| 5,203,098 | 4/1993 | Perissoud et al. | 36/120 X |

FOREIGN PATENT DOCUMENTS

| | | | |
|---|---|---|---|
| 2631398 | 2/1977 | Fed. Rep. of Germany | 36/120 |
| 0286586 | 10/1988 | France . | |
| 0374056 | 6/1990 | France . | |
| 2640123 | 6/1990 | France . | |
| 1087581 | 6/1985 | Italy . | |

*Primary Examiner*—Paul T. Sewell
*Assistant Examiner*—Beth Anne C. Cicconi
*Attorney, Agent, or Firm*—Sandler, Greenblum & Bernstein

[57] ABSTRACT

Rear entry alpine ski boots whose rear spoiler is latchable on the shell base. The rear spoiler includes two segments, one lower and one upper, that overlap and are journalled to each other in a zone corresponding to the journal of the ankle. Only the lower segment is journalled and latchable on the shell base and includes a vertical extension, with which a corresponding portion of the upper segment cooperates in rear-to-front flexion, in order to ensure the control of the flexion forces of the upper towards the front.

23 Claims, 4 Drawing Sheets

SKI BOOT

BACKGROUND OF THE INVENTION

1. Field of the Invention

The present invention is related to ski boots, having a shell base to which an upper is attached, and a rear spoiler journalled on the shell base, that can be latched, in the skiing position, on the sides of the boot, which is connected to the front portion of the upper.

2. Discussion of Background and Material Information

Known ski boots of this type have the advantage of clearing a very large rear portion of the upper, and this facilitates introduction and removal of the foot of the skier. Another advantage lies in the fact that the latching of the rear spoiler on the sides of the boot in the skiing position guarantees a firm and stable rear support. Generally, these boots can be classified in two different categories.

In the first category, as has been disclosed in Italian Patent No. 1,087,581 for example, the upper is capable of pivoting frontwardly by the flexion of the front spoiler, journalled at the end of the boot, in the zone corresponding to the flexion fold of the foot, and by the rotation of the rear spoiler about a journal axis on the shell base which is located, either in the zone corresponding to the heel, or the zone corresponding to the malleolis. Also, as is clear from the description of the boot, the pivot amplitude of the rear spoiler is limited in the area of its latching system on the sides of the latter by the span of at least one nesting slot that cooperates with a projecting element. In such a boot, it appears that it is the flexible quality of the front spoiler alone, in the zone corresponding to the flexion fold, that determines the value of the forces that resist frontward flexion of the upper. Moreover, since the spoiler does not comprise means capable of modifying these flexibility qualities, the value of the resisting forces is fixed immutably, i.e., it cannot be adjusted in accordance with the skill-level of the skier, his weight, his strength, etc.

In the second category, such as has been described in the French Patent Application No. 2,640,123, the upper of the boot includes a front spoiler which is borne by a sleeve journalled on the shell base in the zone of the malleolis and of a rear spoiler journalled on the lower and rear extensions originating from said sleeve in the heel zone. This embodiment differs from the one described previously, in that it is the assembly of the upper, the sleeve as well as the front and rear spoilers, that pivots about a single rotational axis constituted by the journal of the sleeve on the shell base. Moreover, this journal being located in the zone of the malleolis, the upper thus pivots in its entirety about an axis that corresponds substantially to the axis of the ankle. Insofar as controlling the flexion forces is concerned, i.e., the value of the forces resisting the frontward pivoting of the upper, this embodiment of the boot provides for the implementation of control means of a known type, arranged either between the sleeve and the shell base, or between the rear spoiler and the shell base, instead of using the flexibility of the front spoiler as in the Italian Patent No. 1,087,581. It is thus possible to adjust the value of the forces resisting the pivoting of the upper.

As we have just noted in the ski boots described hereinabove, the rear spoiler fulfills a variety of functions: it closes the rear portion of the boot, participates in the retention of the lower part of the leg of the skier when it is connected to the front spoiler in the closure position of the upper, constitutes the main front-to-rear support element because it latches on the sides of the boot, and accompanies the pivoting of the upper in the rear-to-front direction during frontward flexions by the skier. However, the function of controlling the flexion forces is still done, either by the front spoiler, or by specific means interacting between the shell base and a portion of the upper such as the sleeve or the rear spoiler. Such an arrangement in fact localizes all the forces on a single part of the boot, as a matter of fact, on a relatively reduced area of the latter, and necessitates the use of rigid and resistant materials for the manufacture of special provisions on the concerned boot area.

SUMMARY OF THE INVENTION

The present invention proposes to overcome this type of problem in a simple and efficient manner, by providing the rear spoiler with a flexion control system that is specific to it.

Another object of the invention is to provide the rear spoiler with a means that would enable it to accompany the upper of the boot during its frontward pivoting, in conformance with the rotational axis of the ankle of the skier, and at the same time retain its opening journal on the shell base of the boot in the end portion of the heel.

According to the invention, the ski boot comprises a shell base overlaid with an upper enveloping the lower part of the leg of the skier, the upper being obtained in at least two parts, respectively front and rear, having a rear portion comprising a rear spoiler; the latter, in the shape of a semi tube, whose wings extend frontwardly on the sides of the shell base, is connected to this shell base by a journal in the heel zone and is equipped on each wing with a latching means that cooperates, by nesting, with a complementary latching means located correspondingly on the side of the shell base that it covers at least partially in the closed position of the upper. A tightening and maintenance device is associated to the rear spoiler to enable its connection with the front portion of the upper and to guarantee the quality of its latching, in a closed position of the upper, with a view to skiing.

According to one characteristic of the invention, the rear spoiler comprises two distinct segments in the shape of a semi-tube, that are connected by journals, one lower segment, connected to the shell base in the heel zone by its median portion comprised between its wings, and the other upper segment, connected to the first lower segment, by its wings. These two segments at least partially cover each other, the upper segment notably overlapping a vertical extension of the lower segment that extends between the wings of the latter.

Still, according to this characteristic of the invention, the lower and upper segments are connected and journalled to each other by means of two rotating elements located opposite one another on the wings of said segments in the corresponding zone, when the rear spoiler is in a latched position for closure of the upper, to the position of the journal of the ankle. These rotating elements are also used for the assembly of the wings of the segments constituting the rear spoiler, and comprise, to this end, support shoulders or collars, enabling the wings to be held in a "sandwich." The lower segment is connected to the shell base in the heel zone and comprises, on the one hand, on each of its wings, latching means which is adapted to cooperate by nesting with a complementary means located on the corresponding side of the shell base, and, on the other hand, a stop means, prohibiting any pivoting movement of the upper segment about its journal in the front-to-rear direction, beyond a determined angular position.

To summarize, the ski boot which is the object of the invention comprises a shell base overlaid with an upper enveloping the lower part of the leg of the skier, this upper having a front portion and a rear spoiler in the shape of a semi-tube whose wings extend on the sides of the shell base, this rear spoiler being linked by a journal to the latter in the heel zone and being equipped, on each wing, with a latching means cooperating with at least one complementary means located on the corresponding side of said shell base, and characterized by the fact that:

the rear spoiler comprises two distinct segments in the shape of semi-tubes, one lower and one upper, that overlap one another at least partially, and that are journalled to each other on their respective wings and on each side by means of a journal and assembly element, in a zone located substantially in conformance with the journal of the ankle, when the rear spoiler is in the latched position, and that only the lower segment is journalled on the shell base in the heel zone, the lower segment being provided:

with an extension that extends upwardly under the upper segment above a plane passing through its journal axis on the shell base and its journal axis with said upper element, and at least one latching means of the rear spoiler on the sides of the shell base.

According to variations of the embodiment, the stop means of the lower segment is adjustable in position on it, or a complementary stop means located on the upper segment is adjustable in position with respect to the latter. Such an arrangement thus enables the extreme angular position of the upper segment to be adjusted with respect to the shell base in the front-to-rear direction, in the latching position of the rear spoiler.

According to the invention, the vertical extension of the lower segment extends above the plane passing through the journal axis of the latter on the shell base, and through the axis of the journals that connect it to the upper segment. Because of this, that portion of the upper segment that overlaps this extension cannot pivot frontwardly about its axis with respect to the lower segment except along a latching path. In order to achieve one of the objects of the invention, i.e., the control function of the frontward flexion forces, at the level of the rear spoiler, the vertical extension of the lower segment and/or the portion of the upper segment that overlaps this latter, is provided with a flexible zone, with or without a device for adjusting its flexibility. Thus, when the upper segment is biased during frontward flexion, at least one of the segment portions that cover each other produce a resisting force that tends to oppose this pivoting, in the manner of a spring.

In one embodiment of the invention, the journals linking the upper segment to the lower segment each have a provision, adapted to cooperate, in the manner of latch, with a corresponding latching means located on the side of the shell base. Thus, these journals also constitute the latching means of the rear spoiler.

Preferably, the wings of the segments constituting the rear spoiler according to the invention are provided to be flexible in the direction of their separation, such that the latching of the sides of the shell base is done automatically by releasing the latter elements, when the latching means of said spoiler correspond with the latching means located on the sides of the shell base. To this end, the zones of least thickness or flexion may be especially provided in the rear portion, or the dorsal portion, with at least one of the segments of the spoiler.

BRIEF DESCRIPTION OF THE DRAWINGS

The invention will be better understood by referring to the following description, and to the annexed drawings, that illustrate, as non-limiting examples, several embodiments of this invention.

in FIG. 1, the boot has its rear spoiler in the closure position of the upper;

in FIG. 2 the boot is in an open position, its rear spoiler being disconnected from the front portion of the upper, unlatched and folded back towards the rear to clear the opening for the introduction of the foot;

in FIG. 3, the boot is in a position of use, in which its upper is substantially flexed frontwardly, i.e., in the rear-to-front direction.

DETAILED DESCRIPTION OF THE INVENTION

Figure 1:
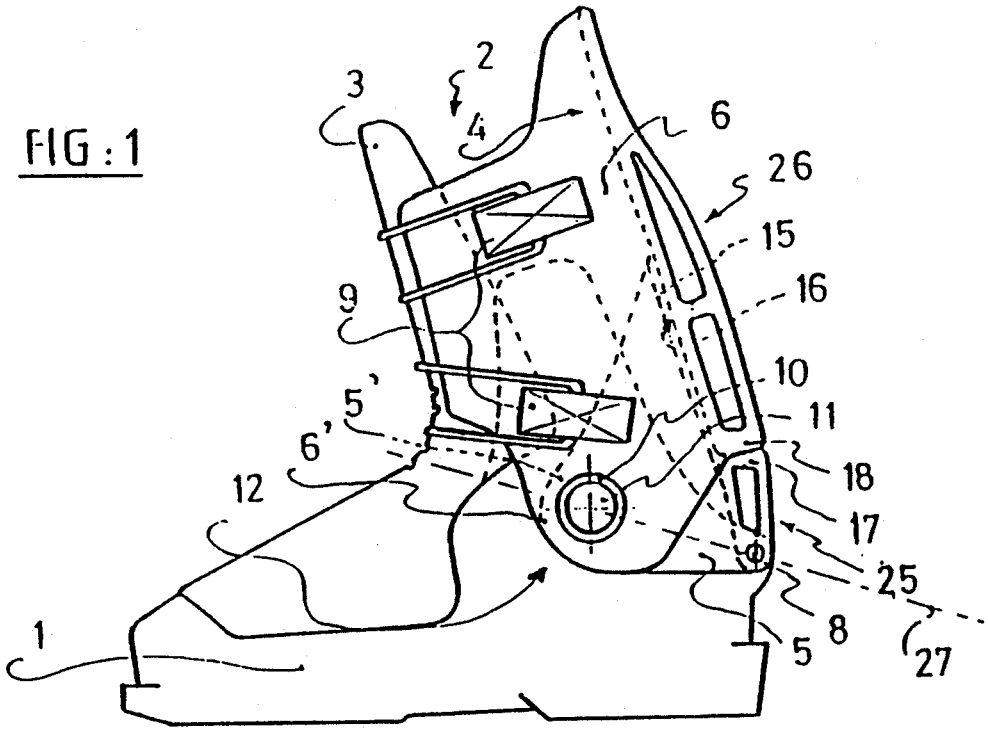
FIGS. 1-3 diagrammatically represent, in a lateral elevational view, a ski boot according to the invention, in three different usage positions.
Figure 2:
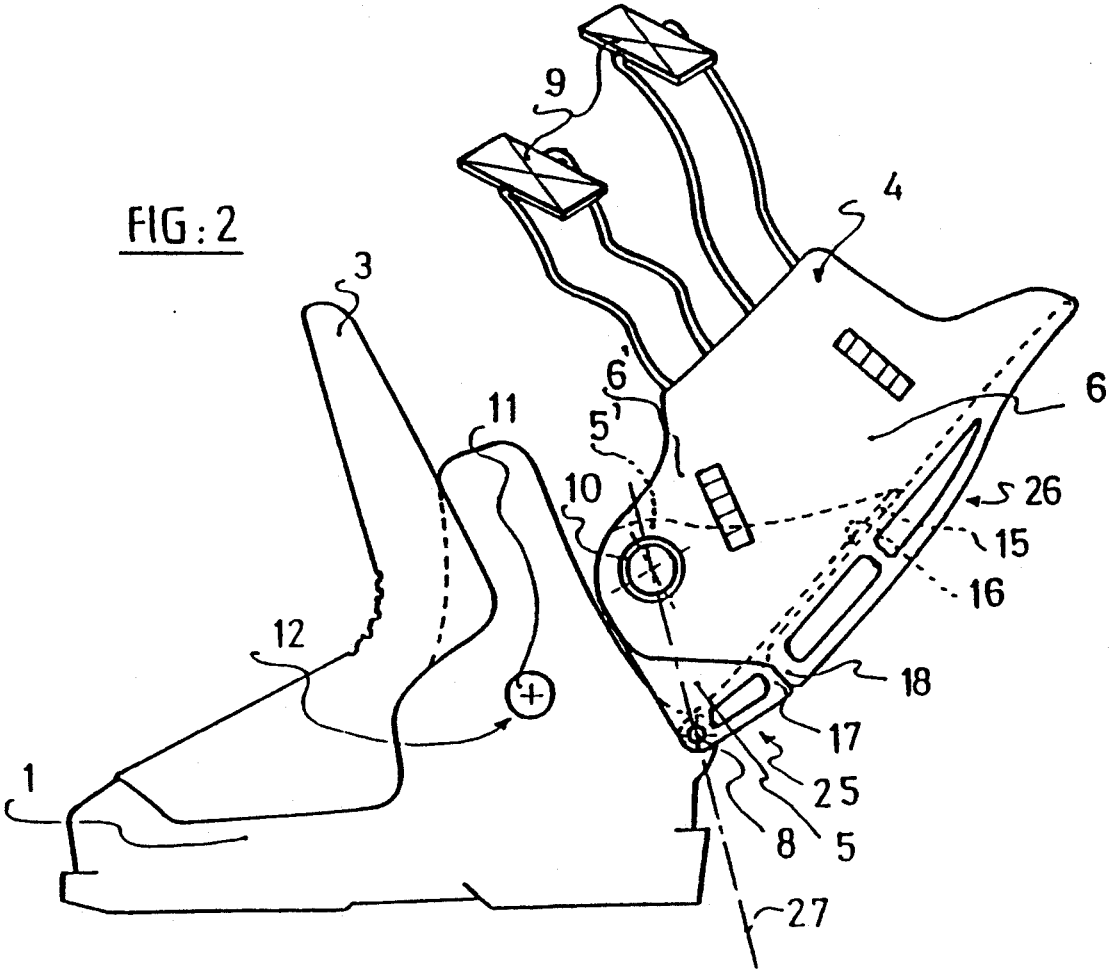

The ski boot illustrated in FIGS. 1-5 comprises a rigid shell base 1 overlaid by an upper 2 which has a front portion 3, or front spoiler, and a rear portion 4, or rear spoiler. According to the invention, the rear spoiler 4 is constituted of two distinct segments, one lower segment 5 and one upper segment 6, to which different and complementary functions are attributed, so as to enable said rear spoiler 4, in its entirety: to close the rear portion of the boot, to ensure retention of the lower part of the leg by connection with the front spoiler, to constitute the main front-to-rear support element by latching on shell base 1, and to accompany the pivoting of upper 2, in front flexion, in conformance with the journal of the ankle, and at the same time opposing an established elastic resistance to ensure a control of the flexion itself.

Figure 3:
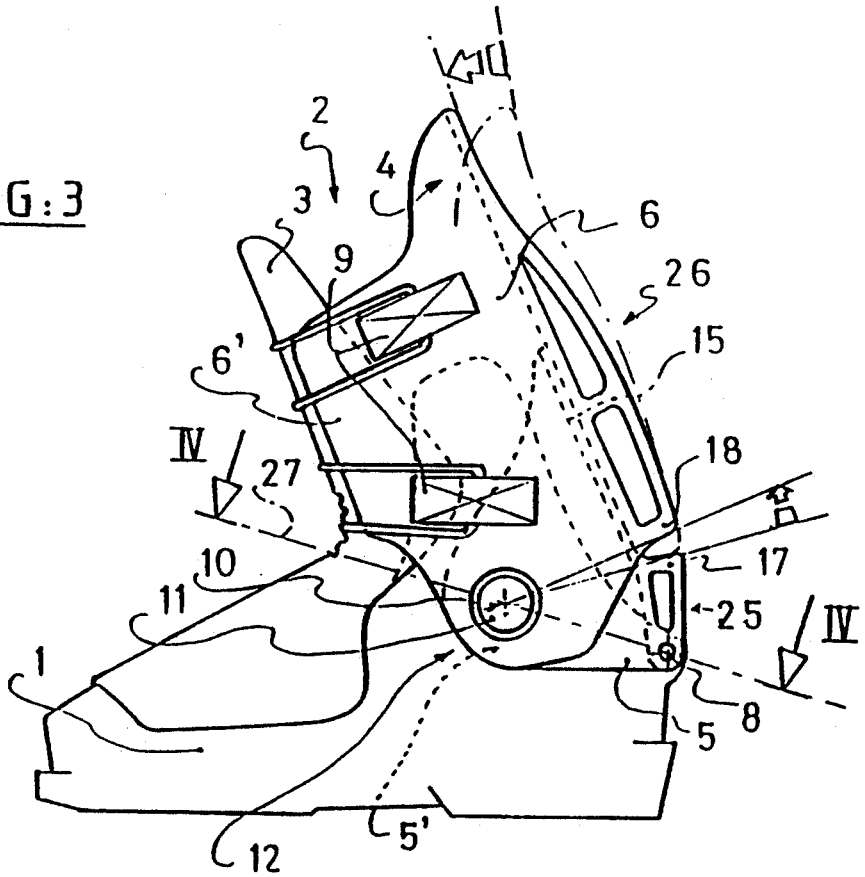

Segments 5 and 6 of rear spoiler 4 have the general shape of semi-tubes, defined respectively, by a dorsal zone 25 and 26 and two lateral wings 5' and 6' that extend frontwardly by at least partially covering the sides of the shell base 1; these segments 5 and 6 are journalled to each other on an assembly element 10 at the level of their wings 5' and 6', element 10 being located in conformance with the journal 12 of the ankle of the skier when rear spoiler 4 is in the closure position of the upper 2, as illustrated in FIGS. 1 and 3.

Preferably, the upper segment 6 covers a vertical extension 15 of the dorsal zone 25 of lower segment 5 and has the function of ensuring retention of the lower part of the leg. To this end, it has wings 6' that extend frontwardly from its dorsal zone 26, up to the front portion 3 of upper 2. A tightening device 9 of a known type, such as a cable with a tension device, is associated to the upper segment 6 to enable its connection with this front portion 3 and to thus achieve closure of upper 2 on the lower part of the leg of the skier.

As regards lower segment 5, this is connected and journalled on the shell base 1 in the heel zone by means of a transverse axis 8 and acts as a connection element between the latter and the upper segment 6.

Figure 5:
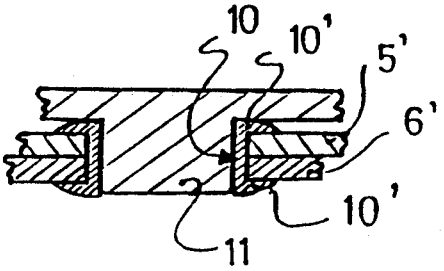
FIG. 5 is an enlarged view of a latch of the rear spoiler on the corresponding side of the boot.

According to one characteristic of the invention, the lower segment 5 has the function of ensuring the pivoting of the entire rear spoiler 4 on shell base 1 in order to open and close the boot, and to ensure latching of said rear spoiler, also in its entirety, on shell base 1. To this end, a latching means 10 is provided on each of its wings 5', adapted to cooperate, by nesting, with a complementary latching means 11 affixed to the corresponding side 12 of said shell base 1. In the present constructional example, the latching means 10, which is also the assembly element 10 and the pivoting element of the two segments 5 and or tubular element 6, on top of one another, may be constituted by a ring provided with retention collars 10' as is illustrated in FIG. 5, and contain a central bore whose dimensions correspond to that of the complementary latching means 11, such as a stud. It becomes clear that the position of the latching means 10–11 coincides with that of the journal 10 of the segments with each other, in conformance with the journal 12 of the ankle of the skier. In order to guarantee the quality of the latching of the ring 10 on stud 11, the tightening device 9 or a part of this device is advantageously located in the vicinity of latch 10–11, such that the joining and/or tightening of wings 6' of the upper segment 6 brings about the contraction of wings 5' of the lower segment 5 on the shell base in this zone especially. Moreover, and still in order to ensure the latching function of the rear spoiler 4, in its entirety, on the shell base, and especially for its blockage in the front-to-rear direction where it constitutes the main retention element of the lower leg of the skier, the lower segment 5 is provided with a stop means 17 in its dorsal zone 25 with which a complementary stop means 18 cooperates, the latter being carried by the upper segment 6 in its dorsal zone 26. Thus, in FIG. 1, the rear spoiler 4, which is connected to the front spoiler 3, is stopped from making any rearward pivotal movement, whether it be about the journal 10 of its segments 5 and 6, or about its axis 8 for connection with the shell base 1.

On the other hand however, in order to achieve a control function for the flexion forces in the rear-to-front direction at the level of the rear spoiler 4, at least one of the portions of the segments 5 and 6 that overlap, i.e., the vertical extension 15 of the dorsal zone 25 of lower segment 5 and the corresponding portion 16 of the dorsal zone 26 of the upper segment 6, is provided to be elastically deformable; also, extension 15 extends upwardly beneath segment 6 above a plane 27 passing through journal axis 8 and the axis of the assembly elements 10, and is enveloped by portion 16 of segment 6 that takes support on it. It is clear from such an arrangement that the upper segment 6 can only pivot in the rear-to-front direction on lower segment 5 along a latching path on extension 15 of the latter. In the embodiment represented, it is the vertical extension 15 of the lower segment 5 which is provided to be deformable. Thus, as has been illustrated in FIG. 3, when upper 2 accompanies the lower part of the leg of a skier towards the front, the upper segment 6 pivots about its journal 10 on the lower segment 5, by elastically and frontwardly deforming the extension 15 of the latter, which remains blocked on shell base 1 by its axis 8 and its latching system 10–11.

Figure 4:
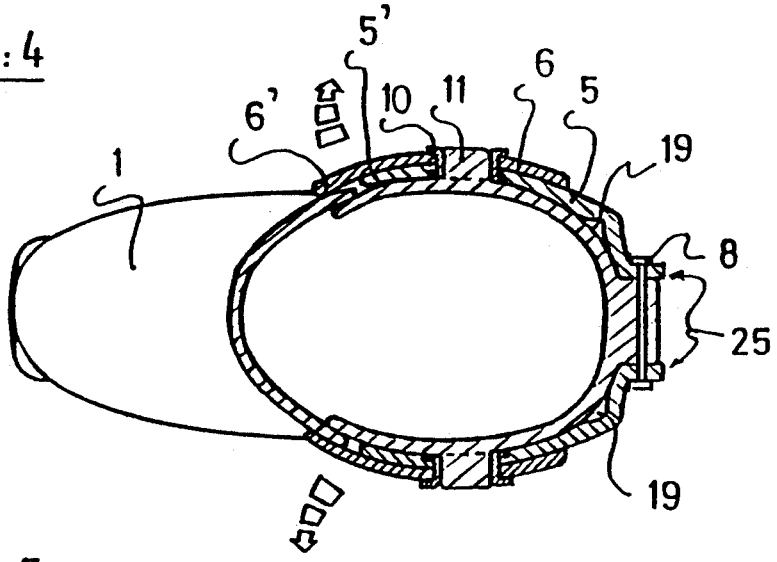
FIG. 4 is a sectional view along line IV—IV of the boot illustrated in FIG. 3, and schematically represents the latching of the rear spoiler.

In order to facilitate the latching-unlatching of the rear spoiler 4 on the shell base 1, wings 5' and 6' of segments 5 and 6 are provided to be elastically deformable in the direction of their separation, as shown by the arrows in FIG. 4. Also, as is visible in FIG. 4, the lower segment 5, at least, may be obtained with a groove 19 that extends substantially parallel, and on either side of its dorsal zone 25, to create a localized or preferential flexion and/or journal zone.

Figure 6:
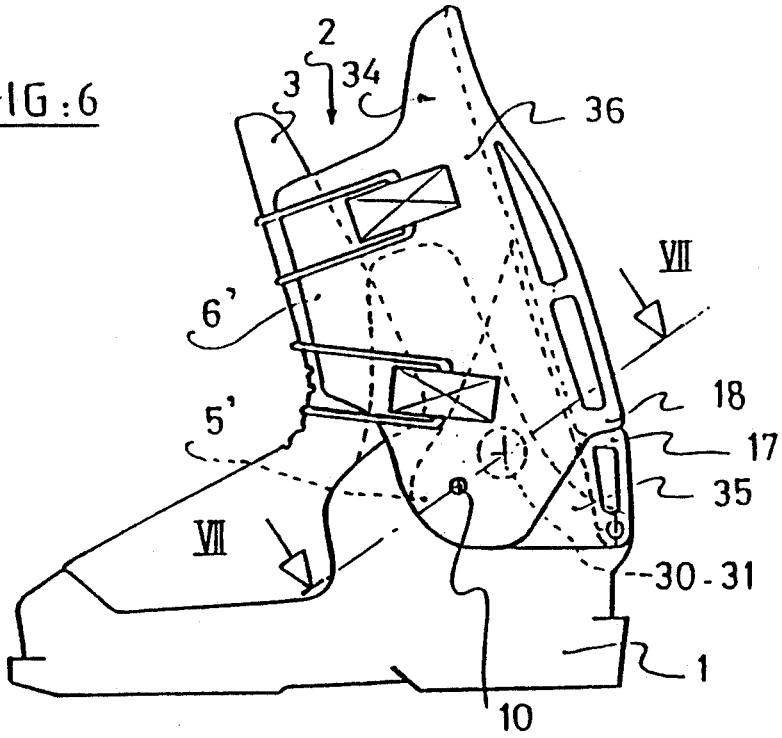
FIG. 6 represents another ski boot, still according to the invention, in which the latching of the rear spoiler is done from at a distance from the journal axis of its segments with each other.

In the embodiment of the invention as represented in FIG. 6, the rear spoiler 34 is constituted of lower segments 35 and upper segments 36 similar to 5 and 6 of the boot described previously. The only difference between this and the latter is the fact that the position of the latching means 30–31 of the rear spoiler 34 on shell base 1 is offset with respect to the journal axis 10 of segments 35–36 one on top of the other, the latter axis remaining located in conformance with the journal of the ankle of the skier when the rear spoiler 34 is in the latched position.

Figure 7:
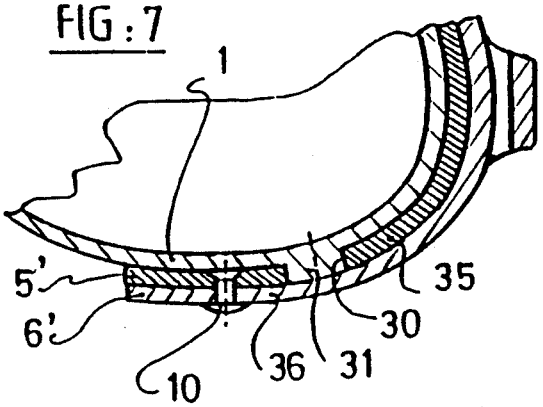
FIG. 7 represents a partial sectional view along line VII—VII of the boot of FIG. 6, and the arrangement of the latching with respect to the journal axis of the segments.

As previously, it is the lower segment 35 that has the function of ensuring the latching of the rear spoiler 34. Thus, to retain the possibility of frontward pivoting of the upper segment 36 with respect to the lower segment 35, stud 31 and latching means 30, such as a corresponding bore, extend exclusively between shell base 1 and said lower segment 35, as shown in FIG. 7.

Figure 8:
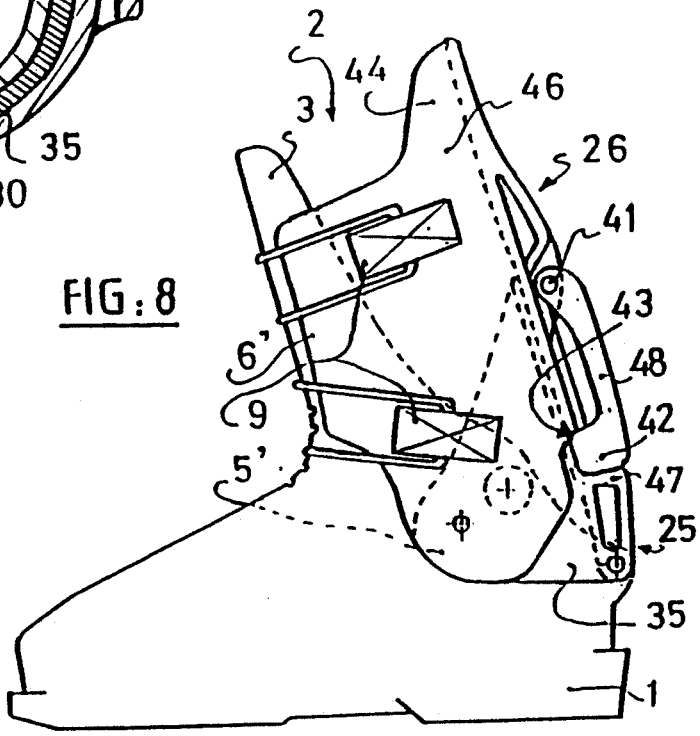
FIG. 8 illustrates an embodiment of the rear spoiler according to the invention, in which the segments are blocked by means of a retractable stop means.

It is of course understood that these special provisions may be adapted to a rear spoiler 34 without leaving the scope of the invention. As an example, rear spoiler 44 of the ski boot illustrated in FIG. 8 comprises an upper segment 46 provided with a stop means 48, retractable with respect to stop means 47 carried by lower segment 35. This stop means 48 is constituted by a cam pivoting about an axis 41 located in the upper portion of the dorsal zone 26 of the upper segment 46, and whose free end 42 is folded back downwardly with respect to the stop means 47 affixed face to face on lower segment 35. In a known manner (not represented), the pivoting cam 48 may, of course, be retained in the stop position by elastic pinching or nesting, or it can be connected to a return spring that tends to maintain it in this position. In the embodiment represented, the free end 42 of cam 48 is wedged between stop 47 of lower segment 35 and a cutout 43 in the shape of an inverted "U" obtained in the lower portion of the dorsal zone 26 of the upper segment 46. It is thus possible to free the upper segment 46 from its blocked position in the front-to-rear direction by lifting the cam 48 outside the cutout 43 and beyond the stop means 47. This arrangement procures an additional function to rear spoiler 44, as it facilitates walking without necessitating opening of tightening device 9, nor necessitating unlatching of the lower segment 35 with respect to shell base 1.

Figure 9:
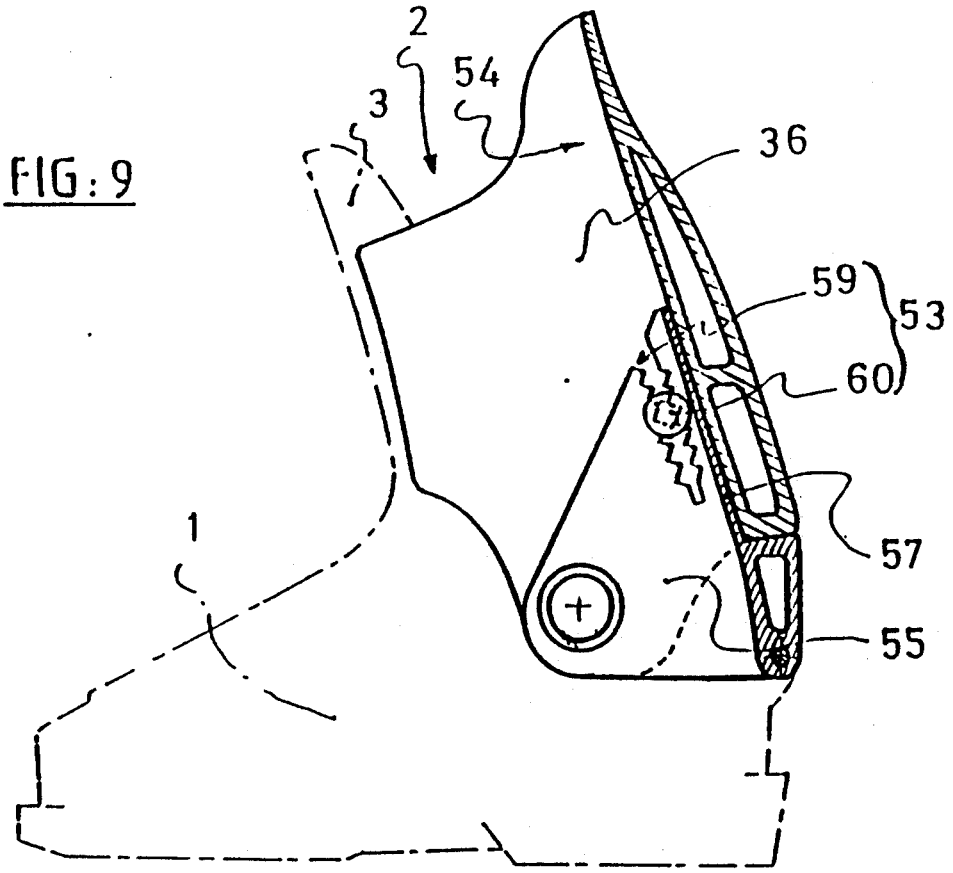
FIG. 9 represents a sectional view of a rear spoiler whose lower segment is provided with an extension that is elastically deformable, and to which an adjustment device is associated.

Also, in FIG. 9, rear spoiler 54 may comprise a lower segment 55 whose vertical extension 57 is provided with an adjustment device 53 adapted to modify its flexibility characteristics. In this example, two serrated slots 59 are provided on either side of vertical extension 57, and a cursor 60, sliding in the slots, enables its active lengths to be modified. As is clear, depending on the more or less elevated position of the cursor, the flexion possibility of extension 57 towards the front varies, both in amplitude and in resisting force.

Figure 10:
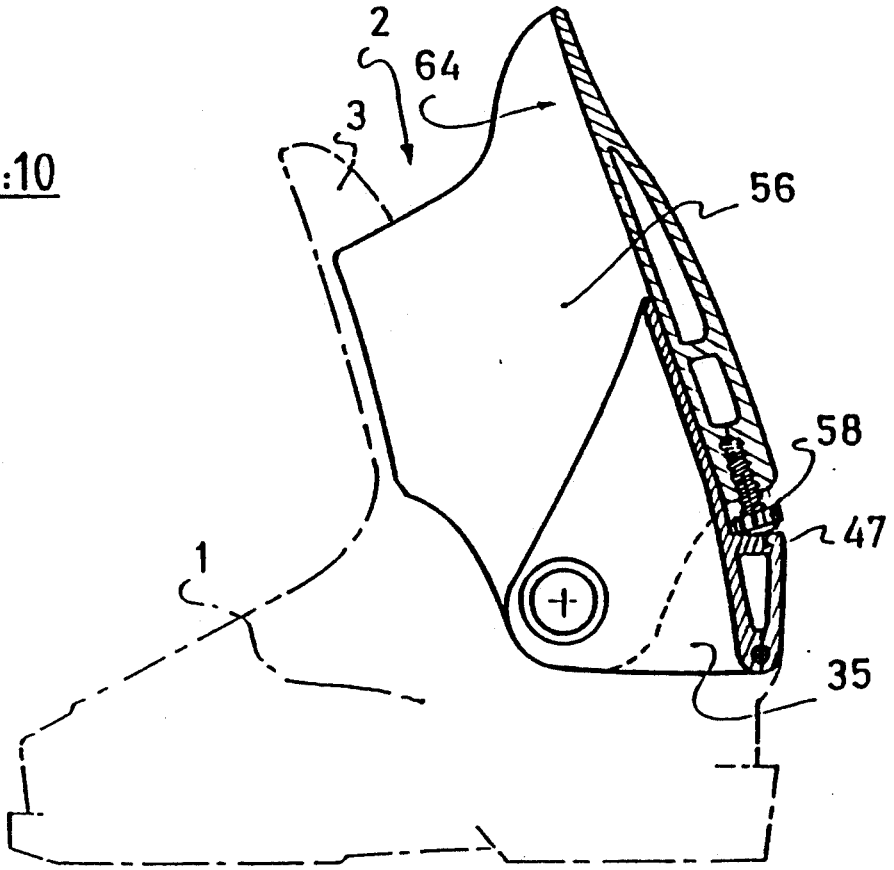
FIG. 10 shows the adaptation of a stop means, adjustable in position, on the upper segment of the rear spoiler.

Finally, in FIG. 10, upper segment 56 of rear spoiler 64 may advantageously be provided with a stop means 58, adjustable in position with respect to a complementary stop means 47 located on lower segment 35. This arrangement enables the regulation, even adjustment, of the extreme angular front-to-rear position of upper segment 56 with respect to the lower segment 35. The upper segment 56 ensures, among others, the function of retention of the lower part of the leg of the skier, its inclination determines the angle of advance, i.e., the inclination of said lower part of the foot with respect to shell base 1 in the latching position of the rear spoiler 64.

The instant application is based upon French patent application 91.01343 of Feb. 1, 1991, the disclosure of which is hereby expressly incorporated by reference thereto, and the priority of which is hereby claimed.

Finally, although the invention has been described with reference of particular means, materials and embodiments, it is to be understood that the invention is not limited to the particulars disclosed and extends to all equivalents within the scope of the claims.

What is claimed is:

1. A ski boot comprising:

a shell base having opposite sides and a heel zone;

an upper extending above said shell base for enveloping the lower portion of the leg of a skier, said upper comprising:

a front portion; and a rear spoiler, said rear spoiler being semi-tubular and comprising at least two laterally opposed wings, said two laterally opposed wings extending along respective ones of said opposite sides of said shell base;

means for journalling said rear spoiler to said shell base about a first axis in said heel area of said shell base;

means for latching each of said wings of said rear spoiler against movement relative to said shell base in a latched position for skiing, said means for latching further comprising means for permitting movement of said rear spoiler to an unlatched position said means for latching comprising one latching means on each of said wings of said rear spoiler cooperating with a respective second complementary latching means on each of said opposite sides of said shell base;

said rear spoiler comprising two distinct semi-tubular segments, said semi-tubular segments comprising an upper segment and a lower segment, said upper segment and said lower segment each comprising two laterally opposed wings for comprising said at least two wings of said rear spoiler, said upper segment and said lower segment at least partially overlapping;

said means for journalling said rear spoiler to said shell base about a first axis comprising means for journalling only said lower segment on said shell base about said first axis in said heel area of said shell base;

means for journalling said upper segment with respect to said lower segment about a second axis at respective wings on respective sides of said upper segment and said lower segment in an area substantially corresponding with the ankle of the skier; and said lower segment of said rear spoiler further comprising:

an extension extending upwardly beneath said upper segment of said rear spoiler above a plane extending through said first axis and said second axis; and wherein said one latching means on each of said wings of said rear spoiler cooperating with a respective second complementary latching means on each of said opposite sides of said shell base comprise one latching means for each of respective pairs of said wings of said lower segment and said upper segment of said rear spoiler on each of said opposite sides of said shell base for cooperating with a respective second complementary latching means on a respective opposite side of said shell base.

2. A ski boot according to claim 1, wherein:

said means for latching each of said wings of said rear spoiler against movement relative to said shell base in a latched position also comprise said means for journalling said upper segment with respect to said lower segment about a second axis, thereby constituting a journal and assembly device.

3. A ski boot according to claim 2, wherein:

said journal and assembly device comprises, on each lateral side of the ski boot, a tubular element extending through respective openings in said upper segment of said rear spoiler and said lower segment of said rear spoiler, each said tubular element having respective ends and a shoulder on each said end to sandwich a respective pair of overlapping wings of said upper segment and said lower segment to provide a non-removable connection between said upper segment and said lower segment, said tubular element comprising an opening extending therethrough; and said journal and assembly device further comprises a latching element on each of said opposite sides of said shell base, whereby each of said latching elements extends through a respective opening of a respective one of said tubular elements of said journal and assembly device in said latched position and whereby each of said latching elements is removable from said respective opening of a respective one of said tubular elements of said journal and assembly device in said unlatched position for enabling rearward movement of said rear spoiler about said first axis with respect to said shell base.

4. A ski boot according to claim 1, wherein:

said means for latching each of said wings of said rear spoiler against movement relative to said shell base in a latched position is positioned along an axis distinct from said second axis.

5. A ski boot according to claim 1, further comprising:

means for tightening and maintaining said upper segment of said rear spoiler with respect to said front portion of said upper.

6. A ski boot according to claim 1, wherein:

at least said extension of said lower segment of said rear spoiler is comprised of a flexible material for comprising means for facilitating forward flexion of said upper.

7. A ski boot according to claim 1, wherein:

said upper segment of said rear spoiler comprises a portion overlapping said extension of said lower segment of said rear spoiler, said overlapping portion being comprised of an elastically deformable material for comprising means for facilitating forward flexion of said upper.

8. A ski boot according to claim 6, wherein:

said upper segment of said rear spoiler comprises a portion overlapping said extension of said lower segment of said rear spoiler, said overlapping portion being comprised of an elastically deformable material for comprising means for facilitating forward flexion of said upper.

9. A ski boot according to claim 1, further comprising:

means for selectively modifying flexibility characteristics of said extension of said lower segment of said rear spoiler for comprising means for facilitating forward flexion of said upper.

10. A ski boot according to claim 1, wherein:

said lower segment of said rear spoiler comprises a lower stop device;

said upper segment of said rear spoiler comprises an upper stop device; and said lower stop device and said upper stop device comprise means for stopping rearward pivotal movement of said upper segment of said rear spoiler about said second axis beyond a predetermined position.

11. A ski boot according to claim 10, wherein:

each of said upper stop device and said lower stop device comprise a respective complementary engaging portion; and one of said upper stop device and said lower stop device comprises means for adjusting a position of its complementary engaging portion with respect to its respective segment of said rear spoiler.

12. A ski boot according to claim 10, wherein:

each of said upper stop device and said lower stop device comprise a respective complementary engaging portion; and one of said upper stop device and said lower stop device comprises means for retracting its complementary engaging portion from a position against engagement with the other of said upper stop device and said lower stop device and for enabling rearward pivotal movement of said upper segment rearwardly beyond said predetermined position.

13. A ski boot according to claim 1, wherein:

at least the laterally opposed winds of one of said upper segment of said rear spoiler and said lower segment of said rear spoiler comprise respective rear portions; and said respective rear portions comprise grooves, said grooves comprising means for decoupling said laterally opposed wings for facilitating movement of said rear spoiler to said unlatched position.

14. A ski boot according to claim 1, wherein:

means for journalling said upper segment with respect to said lower segment about a second axis at respective wings on respective sides of said upper segment and said lower segment in an area substantially corresponding with the angle of the skier comprises means for enabling forward flexional movement of said upper segment about said second axis with respect to said lower segment.

15. A ski boot comprising:

a shell base having opposite sides and a heel zone;

an upper extending above said shell base for enveloping the lower portion of the leg of a skier, said upper comprising:

a front portion; and a rear spoiler comprising an upper segment and a lower segment, each of said upper segment and said lower segment comprising two laterally opposed wings extending along respective ones of said opposite sides of said shell base;

means for journalling said lower segment of said rear spoiler to said shell base about a first axis in said heel area of said shell base;

means for journalling said upper segment with respect to said lower segment about a second axis at respective wings on respective sides of said upper segment and said lower segment in an area substantially corresponding with the ankle of the skier, said first axis and said second axis being substantially parallel;

means for latching each of said wings of said upper segment and said lower segment against movement relative to said shell base in a latched position, said means for latching further comprising means for permitting movement of said rear spoiler to an unlatched position, said means for latching comprising one latching member on each of said wings of said lower segment of said rear spoiler for cooperating with a respective second complementary latching member on each of said opposite sides of said shell base; and said lower segment of said rear spoiler further comprising an extension extending upwardly beneath said upper segment of said rear spoiler above a plane defined by said first axis and said second axis.

16. A ski boot according to claim 15, wherein:

said means or latching each of said wings against movement relative to said shell base in a latched position also comprise said means for journalling said upper segment with respect to said lower segment about a second axis, thereby constituting a journal and assembly device.

17. A ski boot according to claim 15, wherein:

said means for latching each of said wings against movement relative to said shell base in a latched position is positioned along a third axis distinct from said second axis.

18. A ski boot according to claim 15, further comprising:

means for tightening and maintaining said upper segment of said rear spoiler with respect to said front portion of said upper comprising:

at least one cable positioned in front of a forward surface of said front portion of the ski boot and extending from one of said two wings of said upper segment to another of said two wings of said upper segment; and means for tensioning said at least one cable.

19. A ski boot according to claim 15, wherein:

at least said extension of said lower segment of said rear spoiler is comprised of an elastically deformable material for facilitating forward flexion of said upper.

20. A ski boot according to claim 19, wherein:

said upper segment of said rear spoiler comprises a portion overlapping said extension of said lower segment of said rear spoiler, said overlapping portion being comprised of an elastically deformable material for comprising means for facilitating forward flexion of said upper.

21. A ski boot according to claim 15, wherein:

said lower segment of said rear spoiler comprises a lower stop device;

said upper segment of said rear spoiler comprises an upper stop device; and said lower stop device and said upper stop device comprise means for stopping rearward pivotal movement of said upper segment of said rear spoiler about said second axis beyond a predetermined position.

22. A ski boot according to claim 15, wherein:

at least the laterally opposed wings of one of said upper segment of said rear spoiler and said lower segment of said rear spoiler comprise respective rear portions; and said respective rear portions comprise vertically extending grooves, said grooves comprising means for facilitating decoupling of said laterally opposed wings for facilitating movement of said rear spoiler to said unlatched position.

23. A ski boot according to claim 15, wherein:

said means for permitting movement of said rear spoiler to an unlatched position comprises said wings of said upper segment and said lower segment being formed of an elastically deformable material for permitting elastic deformation of two pairs of wings of said upper segment and said lower segment on respective sides of said shell base in opposite lateral directions to space said two pairs of wings apart and away from engagement with respective ones of said second complementary latching means on said opposite sides of said shell base for permitting said rear spoiler to move rearwardly about said first axis.

* * * * *